United States Patent [19]

Melgaard

[11] 4,208,572

[45] Jun. 17, 1980

[54] OVEN

[75] Inventor: Hans L. Melgaard, Minneapolis, Minn.

[73] Assignee: Despatch Industries, Inc., Minneapolis, Minn.

[21] Appl. No.: 799,105

[22] Filed: May 20, 1977

[51] Int. Cl.[2] ..... H05B 9/06; H05B 1/02

[52] U.S. Cl. ..... 219/400; 165/169; 236/15 A; 219/364; 219/367; 219/369

[58] Field of Search ..... 219/359, 364, 365, 367, 219/374, 378, 399, 400, 405, 408, 412, 413; 432/192, 199, 177; 34/225, 35, 86; 165/169; 236/15 B, 38, 60; 126/285 B

[56] References Cited

U.S. PATENT DOCUMENTS

| | | | |
|---|---|---|---|
| 2,606,372 | 8/1952 | Foulder et al. | 34/225 X |
| 3,198,503 | 8/1965 | Eichelberg et al. | 432/199 X |
| 3,364,912 | 1/1968 | Dills et al. | 219/400 |
| 3,367,316 | 2/1968 | Eff | 219/400 X |
| 3,445,939 | 5/1969 | Malmquist | 34/225 |
| 3,626,154 | 12/1971 | Reed | 219/405 |
| 3,686,476 | 8/1972 | Schaver, Jr. | 219/413 |
| 3,783,219 | 1/1974 | Tateda | 219/400 X |
| 3,885,126 | 5/1975 | Sugiyama et al. | 219/364 |
| 3,917,444 | 11/1975 | Carthew | 34/35 |
| 4,029,463 | 6/1977 | Johansson et al. | 219/400 |

FOREIGN PATENT DOCUMENTS

| | | | |
|---|---|---|---|
| 624309 | 6/1949 | United Kingdom | 219/498 |

*Primary Examiner*—B. A. Reynolds
*Assistant Examiner*—M. H. Paschall
*Attorney, Agent, or Firm*—James R. Haller

[57] ABSTRACT

An oven having an electrical resistance heater and a heat exchanger to maintain a constant temperature in an oven chamber cavity. The heat exchanger is internal to the body of the oven and adjacent to the oven chamber cavity. Air is the exchange medium in the heat exchanger to achieve a balanced, cooling effect through direct air exhaust and also to achieve zero environment effect. An inert gas may be introduced into the oven chamber cavity during the heating process to reduce oxidation. Outside air may also be introduced into the oven during the heating process. Electrical circuitry provides for controlling the temperature range of the oven, for generating a signal for servo motor control of a damper in the heat exchanger, and a high limit temperature controller to disable the electrical resistance heater when an over temperature condition is reached.

11 Claims, 3 Drawing Figures

OVEN

BACKGROUND OF THE INVENTION

1. Field of the Invention

The present invention relates generally to improvements in an oven, and more particularly pertains to a new and improved oven utilizing electrical resistance heating wherein the oven has three modes of operation. The first mode is utilization of air in a heat exchanger integral to the body of the oven chamber cavity; second, the use of inert gas atmosphere inside the oven chamber cavity, and; third; the use of air as a direct exchange medium inside the oven chamber cavity.

2. Description of the Prior Art

In the field of ovens, it has been a general practice in the art to employ external heat exchangers such as water heat exchangers as the medium for cooling the ovens. Such devices have been unsatisfactory in that water heat exchangers require extensive plumbing connections to an oven in addition to the consumption of large quantities of water as an exchange medium to cool or maintain the oven at a precise temperature. Also, other types of external heat exchangers have proven to be bulky and sometimes larger than the oven itself requiring extensive sheet metal duct work necessary to cool or maintain the oven within a precise temperature range. Also some prior art heat exchangers failed to maintain the oven within a desired temperature range.

Further, some prior art ovens have utilized manually operated dampers which are less than satisfactory in not precisely maintaining the temperature range of the oven within a desirable range. Such dampers are time consuming and tricky to operate as manual adjustment is continuously required by an operator trying to maintain the oven temperature within a precise temperature range.

SUMMARY OF THE INVENTION

The present invention obviates foregoing disadvantages of prior art ovens by providing an oven using air as the heat exchanger medium and a servo controlled damper.

According to one embodiment of the present invention, there is provided an oven having a heat exchanger integral to the body of the oven chamber cavity, a servo controlled damper located in the heat exchanger, an electrical resistance heater to heat the air internal to the oven chamber cavity, an inert gas system to purge the oven and maintain an inert atmosphere in the oven, an outside air system, a temperature controller to maintain a constant temperature in the oven, and a high limit temperature control to disable the system in the event of an over temperature condition.

A significant aspect and feature of the present invention is a heat exchanger which is integral to the body of the oven. A ventilation supply duct surrounds both sides of the oven chamber cavity to permit flow of air through the oven chamber cavity, an electrical resistance heater, and across the heat exchanger. Outside air is ducted through the heat exchanger and the flow of the air is controlled by a servo controlled damper to maintain the temperature of the oven within a precise range.

Another significant aspect and feature of the present invention is the use of air as an exchange medium where outside air is ducted into the oven and the discharge exhausted air is ducted back outside of the oven permitting a zero environmental effect within the surrounding area of the oven.

A further significant aspect and feature of the present invention is a temperature controller which maintains the operating temperature range within one percent of the rise of the ambient temperature.

Having briefly described an embodiment of the present invention, it is a principal object thereof to provide a new and improved oven.

An object of the present invention is to provide an oven having a heat exchanger integral to the body of the oven and using air as the exchange medium.

Another object of the invention is to provide the capability of using air ducted directly into and out of the oven as a second exchange medium. Outside air is ducted into the oven and the discharge exhausted air is ducted back outside of the oven, preferably to an area not adjacent to the oven so as to permit a zero environmental effect in the operating area of the oven. Such an example would be ducting air in and out through the walls of a building into the adjacent outside area thereby permitting zero environmental effect in the room in which the oven is operating.

A further object of the invention is to provide an electrical system which controls the operating range of the oven within one percent of the rise of the ambient temperature through the use of a temperature controller. The temperature controller also generates a signal to controllably regulate a damper in the heat exchanger with a feedback servo control circuit to maintain the operating range of within the desired temperature range. Also, a high limit temperature controller automatically disables the system upon sensing an over temperature condition thereby sounding an alarm and disabling the electrical resistance heater located inside the oven but external to the oven chamber cavity.

Still another object of the invention is to provide an inert gas system to purge the oven and maintain a desired inert gas-oxygen level within the oven during a heating cycle.

An additional object of the invention is an oven which can be used to "burn-in" integrated circuits percisely without oxidation occurring on the leads of the IC's. Electrical power cables are fed through an access port in the rear wall of the oven to power the integrated circuits. The electrical resistance heater provides heat to maintain a precise temperature range during the burn-in process. The heat exchanger integral to the oven body maintains the temperature range within at a precise range through the use of the servo-controller damper in the heat exchanger. If in the event during the burn-in cycle the temperature exceeds the range, the high limit temperature controller upon sensing an over temperature condition disables the electrical resistance heater, sounds an alarm.

BRIEF DESCRIPTION OF THE DRAWING

Other objects and many of the attendant advantages of this invention will be readily appreciated as the same becomes better understood by reference to the following detailed description when considered in connection with the accompanying drawings, in which like references numerals designate like parts throughout the figures thereof and wherein.

DESCRIPTION OF THE PREFERRED EMBODIMENT

Figure 2:
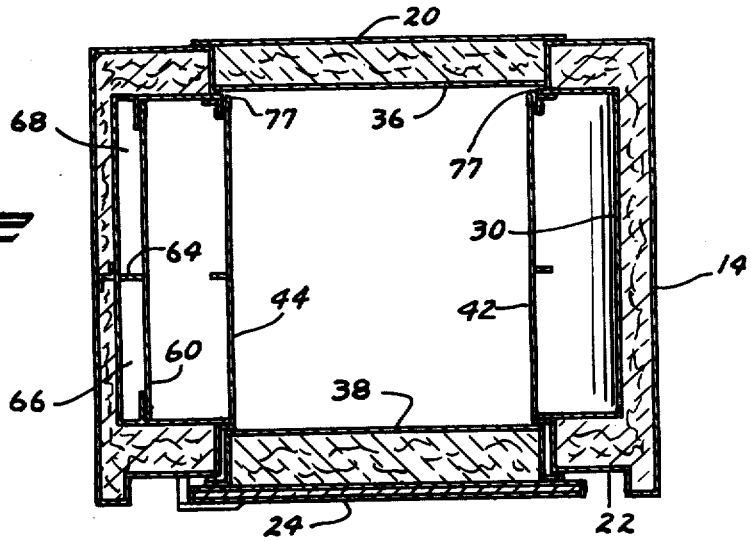
FIG. 2 illustrates a section of the oven taken on the line 2—2 of FIG. 1 looking in the direction of the arrows.
Figure 1:
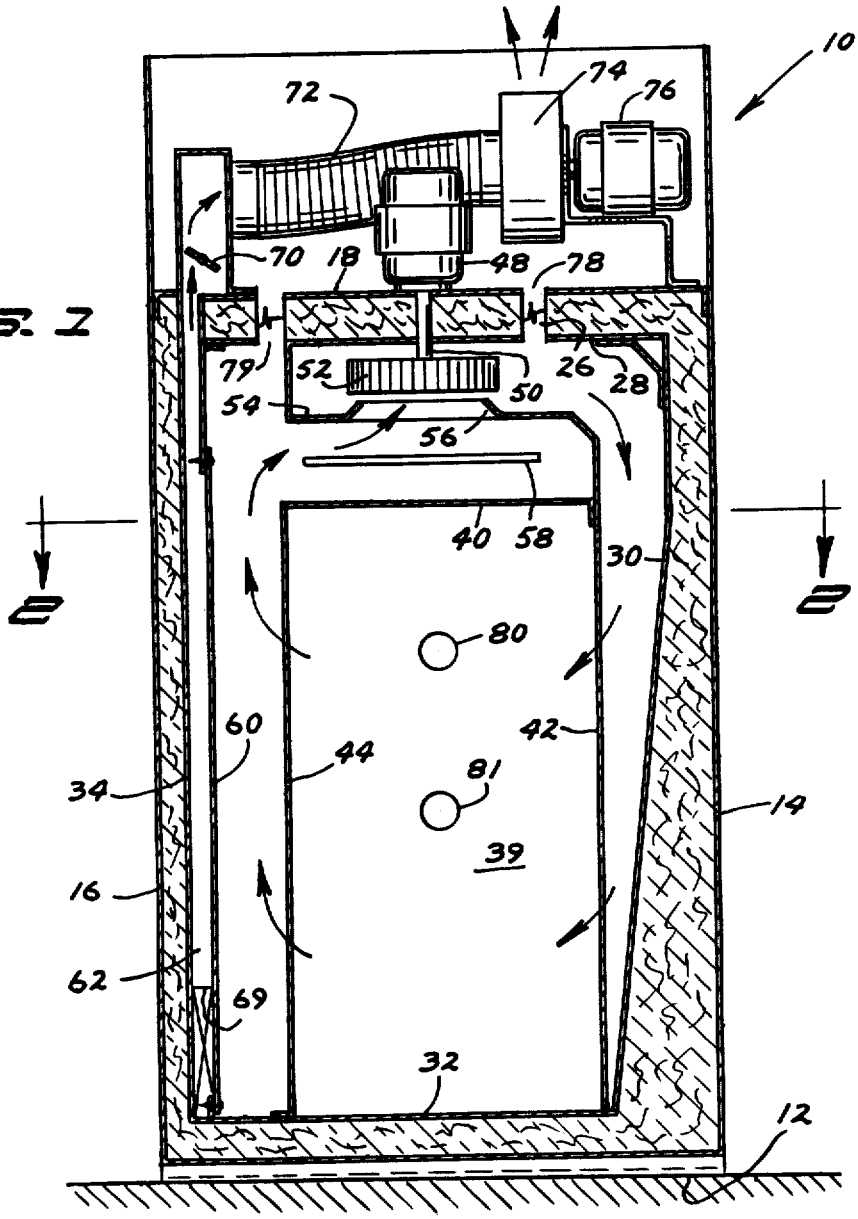
FIG. 1 illustrates a front cutaway view of a preferred embodiment of the invention.

FIG. 1, which illustrates a front cutaway view of a preferred embodiment of an oven 10, the invention, shows a housing base 12, a housing right side wall 14, a housing left side wall 16, a housing top 18, a housing rear wall 20 as shown in FIG. 2, and a front housing front wall 22. A door 24 as shown in FIG. 2 overlaps the front housing wall 22. An insulation 26 is disposed between an upper supply duct wall 28 and the housing top 18, a side supply duct wall 28 and the housing top 18, a side supply duct wall 30 and the housing right side wall 14, an oven base 32 and the housing base 12, an outer heat exchanger baffle wall 34 and the housing left side wall 16, an oven rear wall 36 and the housing rear wall 20 as shown in FIG. 2, and an oven front wall 38 in the door 24 as shown in FIG. 2. The oven chamber cavity 39 consists of an oven top 40, a perforated oven right side wall 42, a perforated left side wall 44, the oven base 32, the oven rear wall 36 as shown in FIG. 2, and the oven front wall 38 as shown in FIG. 2.

A recirculating motor 48 secures to the top wall 18 and a shaft 50 from the recirculating motor 48 extends through the top wall 18, the insulation 26, and the upper supply duct wall 28 having an atmospheric shaft seal to rotatably drive a recirculating fan 52. The motor 48 connects to a switched electrical power source as described in FIG. 3. The recirculating fan 52 is disposed between the upper supply duct wall 28 and a lower supply duct wall 54 which connects between the leftward portion of the upper supply duct wall 28 and the rightward portion of the oven top 40. A flanged circular semi-spherical dish opening 56 is disposed in the lower supply duct wall 54 directly below the recirculating fan 52. An electrical resistance heater 58 affixes between the oven top 40 and the lower supply duct wall 28 and connects to a switched electrical power source as described in FIG. 3.

An inner heat exchanger baffle wall 60 along with the outer heat exchanger baffle wall 34 extends the length of the housing left side wall 16 forming the heat exchanger 62. A dividing member 64 as shown in FIG. 2 divides the heat exchanger baffle into an air inlet duct portion 66 and an air outlet duct portion 68. The lower most portion of the dividing member 64 terminates at 69, a distance above the bottom of the inner and outer heat exchanger baffle walls 34 and 60 to provide a continuous path for air circulation. A servo motor controlled damper 70 rotatably mounts in the air outlet duct portion 68 of the heat exchanger 62 to controllably regulate the flow rate of air through the heat exchanger 62 as described in FIG. 3.

An exhaust duct 72 connects to the air outlet duct portion of the heat exchanger 68. An exhaust fan 74 driven by a motor 76 discharges the exhausted air from the exhaust duct 72 to the outside environment. The air inlet duct portion 66 and the exhaust fan 74 may connect to the outside environment through suitable connecting duct work.

An atmospheric inlet 78 and an atmospheric outlet 79 communicate through the insulation 26 to the housing top wall 18 to provide medium communication between the outside atmosphere and the oven chamber cavity 39. The atmospheric inlet 78 and outlet 79 further have valves to controllably regulate the air flow and suitable connecting duct work to the outside environment.

An access port 80 communicates from the oven rear wall 36 through the insulation 26 to the housing rear wall 20 as shown in FIGS. 1 and 2 to provide for electrical cables passing from the oven chamber cavity 39 to the outside environment. Silicone, epoxy, or other suitable cement materials fills the access port 80 and surrounds the electrical cables to provide an atmospheric seal between the oven chamber cavity 39 and the outside environment. An inlet gas port 81 which passes through the oven rear wall 36, the insulation 26, and the housing rear wall 20 connects to the valves 188 and 192 of FIG. 3 as later described.

FIG. 2, which illustrates a sectional view of the oven 10 taken on the line 2—2 of FIG. 1 looking in the direction of the arrows, shows the housing front wall 22 and the oven front wall 38 positioned on the door 24 which isolates the oven chamber 39 cavity from the outside environment.

The air inlet duct portion 66, the air outlet duct portion 68, and the dividing member 64 are shown on one side of the oven 10. The housing right side wall 14 and the side supply duct wall 30 are shown on the other side of the oven 10. Seals are provided to permit removal of a section of the housing rear wall 20 and the oven rear wall 36 which may be a continuous member, and to seal the door 24 against the housing front wall 22.

Figure 3:
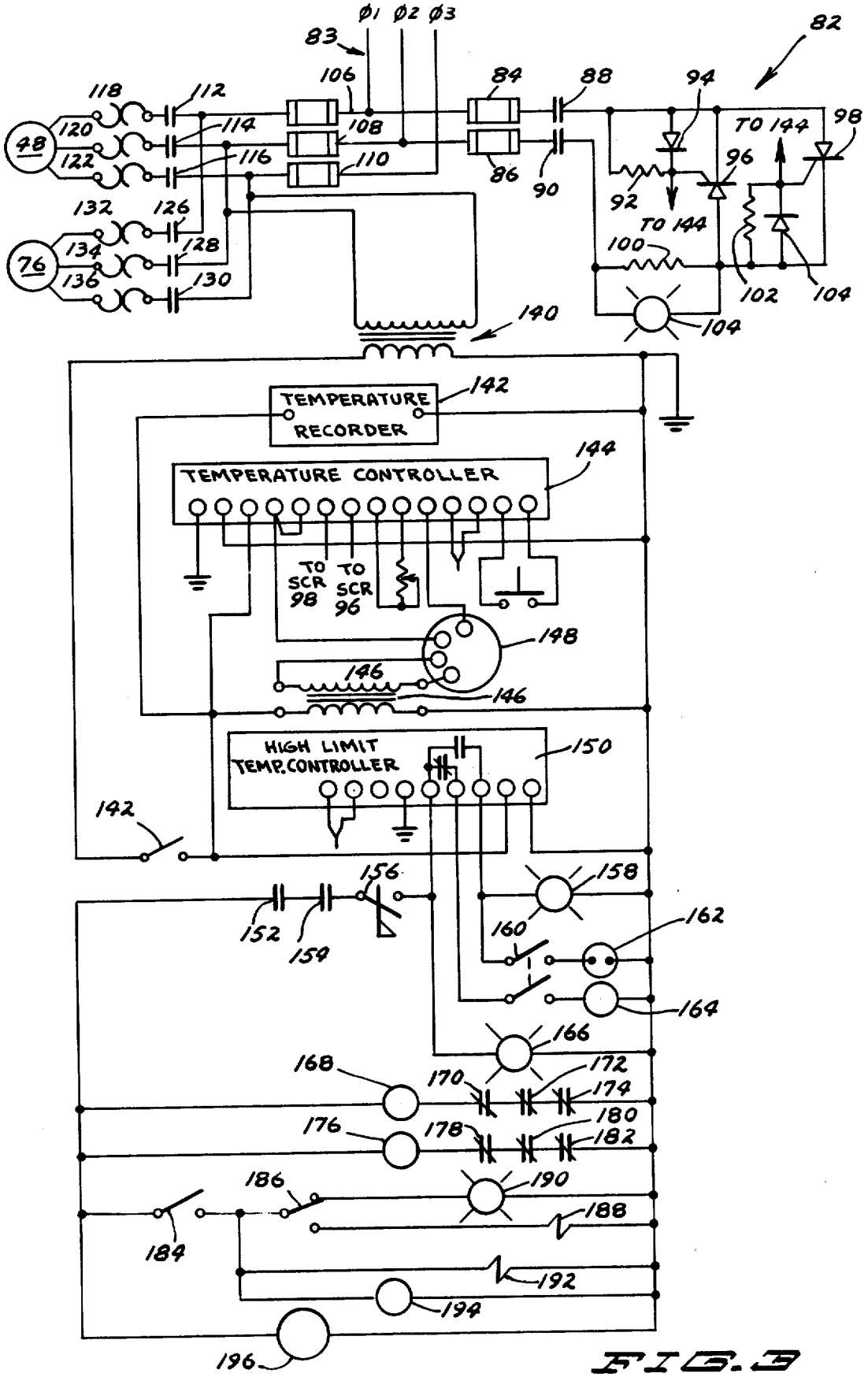
FIG. 3 illustrates an electrical schematic of the control circuitry for the oven.

FIG. 3, which illustrates an electrical circuit schematic 82 for the preferred embodiment of the oven, shows an incoming three phase power source 83 of electrical power such as a 240 volt-3 phase-60 hertz power line. Phase 1 and 2 of three phase power source 83 connects to fuses 84 and 86 in series with contactors 88 and 90 respectively. A resistor 92, an anode of a diode 94, a cathode of a silicon controlled rectifier (SCR) diode 96, and an anode of a SCR diode 98 connect to the contractor 88. The other side of the resistor 92 and the diode 94 connect to the gate of the SCR diode 96. One side of a heater 100 connects to a contactor 90. The other side of the heater 100 connects to the anode of the SCR diode 96, the cathode of the SCR diode 98, the resistor 102, and the anode of the diode 104. A pilot light 104 connects in parallel with the heater 100.

Phase 1, 2 and 3 of the three phase power source 83 also connects to fuses 106, 108 and 110. Each phase of the three phase power source 83 connects to the recirculating motor 48 through a contactor 112–116 in series with an overload protector 118–122 respectively. Likewise, each phase of the three power source connects to the exhaust fan motor 76 through a contactor 126–130 in series with an overload protector 132–136. The primary winding of a power transformer 140 connects to phase 2 and 3 of the three phase power source 82 and the secondary winding of the power transformer 140 provides electrical power for the control circuitry. One side of the secondary winding of the power transformer 140 connects to a common ground and the other side connects to an off-on power switch 142.

A temperature recorder 144 connects between the switch 142 and ground. A Model 61-06-AA DESPATCH 0°-210° C. Type J Temperature Controller or any suitable substitute therefor denoted as 144 connects between the switch 142 and ground. The primary winding of a voltage step-down transformer 146 connects between switch 142 and ground. A control motor 148 between the secondary winding of the voltage step-down transformer 146 and the temperature controller to regulate the position of the damper 70 of FIG. 1. A Model AV551AB125 Honeywell Hi-Limit 0°-300° C. Type J Temperature Controller or any suitable substitute therefor denoted as 150 connects between the switch 142 and ground. Normally open motor starter contacts 152 for the recirculating motor 48 and normally open motor starter connects 154 for the exhaust fan motor 76 in addition to air flow switch 156 in series with the motor starter contacts 152 and 154 connect between the switch 142 and the high limit temperature controller 150. An over temperature light 158 connects from the high limit temperature controller 150 to ground. A single throw double pole (STDP) switch 160 connects from terminals 6 and 7 of the high limit temperature controller 150 to the respective first and second poles of the switch 160 respectively. An alarm horn 162 connects between the first pole of the STDP switch 160 and ground. A contactor coil 164 connects between the second pole of the STDP switch 160 and ground. A fan running light 166 connects between terminal 5 of the high limit temperature controller 150 and ground.

Motor starter coil 168 for the recirculating motor 48 in series with normally closed contacts 170, overload contact 172, and contact 174 connect between switch 142 and ground. Motor starter coil 176 for the exhaust fan motor 76 in series with normally closed contacts 178, overload contactor 180, and contact 182 connect between the switch 142 and ground.

A single pole single throw (SPST) inert gas off-on switch 184 connects between the switch 142 and an automatic interval purge switch 186 of a Model 7003 BECKMAN Oxygen Controller or any suitable substitute therefor. A solenoid valve 188 internal to the oxygen controller connects to one contact of the purge switch 186 and a light 190 connects to the other side of the purge switch 186. A solenoid valve 192 connects between switch 184 and ground which permits inert gas to continuously flow when the switch 184 is closed. A relay coil 194 for the oxygen controller connects between the off-on switch 184 and ground. An oven equipment cooling fan 196 connects between the switch 142 and the ground.

Preferred Mode of Operation

The oven 10 is placed into a level physical condition to assure optimum heat distribution in the oven chamber cavity 39. The electrical circuitry 82 of the oven 10 is connected to a three phase source of electrical power to provide power for the electrical and electromechanical components of the oven 10. Appropriate, suitable duct work connects the oven 10 from the outside environment to the air inlet duct portion 66, the air outlet duct portion 68, the atmospheric inlet 78, and the atmospheric outlet 79 as shown in FIG. 1. The outside environment is not construed as limiting to the area of the physical operation of the oven 10 but also includes the physical area beyond the oven 10 such as the area outside a physical building which is accessible through the use of sheet metal duct work. Any electrical cables are fed through the access port 80 which is then sealed with a suitable sealant to provide for an atmospheric seal. A source of inert gas not shown in the drawings is connected to the valves 188 and 192 shown in FIG. 3.

When the off-on switch 142 is energized, the exhaust fan motor 76 and recirculating fan motor 42 are switched on and powered by the three phase power source 83 through the back-up contactors 112–116 and 126–130 by energizing the motor starter coils 168 and 176 respectively. Fuses 106–110 and overload protectors 118–122 and 126–130 in conjunction with normally closed contacts 170–174 and 178–182 respectively provide current and overload surge protection for the motors 48 and 76.

Switch 142 also powers the temperature recorder 142 which records the temperature in the oven chamber cavity 39, the temperature controller 144 which controls the temperature in the oven chamber cavity 39, and the high-limit temperature controller 150 which sounds an alarm and disables the heating system until the controller is reset if an over temperature is reached. Normally open contacts 152 and 154 are internal to the motor staters for the recirculating fan motor 48 and the exhaust fan motor 76. The air flow switch 156 is interlocked to the recirculating fan motor 48 and which also connects to an internal switch in the high limit temperature controller 150. In the normal mode of operation, the air flow switch 156 is on except when a air flow failure condition exists. Light 166 lights to indicate that the recirculating fan 48 and the exhaust fan 76 are energized.

When an over temperature condition exists and exceeds the setting of the high limit temperature controller 150, the light 158 illuminates, the alarm 162 sounds, and the contactor 164 opens disconnecting the heater 100 from the temperature controller 144 through back up contactors 88 and 90. The switch 160 silences the alarm 162 and turns the heater 100 off.

The temperature controller 144 controls the power to the electrical resistance heater 100 by switching the gates of the SCR diodes 96 and 98. Proportional signals from terminals 6 and 7 of the temperature controller 144 connect to the gates of SCR diodes 98 and 96 respectively and the resistor-diode combination 92–94 and 102–104 respectively which also connect to the gates of the SCR diodes 96 and 98 perform the gating operation of the diodes. The temperature controller 144 also powers the servo control motor 148 through a temperature feedback loop to regulate the position of the damper 70 in the air outlet duct portion 68 of the oven 10 as shown in FIG. 1.

Switch 184 turns on the oxygen controller through the coil 194 to automatically purge the oven chamber cavity 39 with a high rate of inert gas such as nitrogen through the solenoid valve 188 and upon reaching a desired level of oxygen such as 0.5 percent, the light 190 automatically lights upon switching of the switch 186 internal to the oxygen controller. The solenoid 192 is manually controlled to permit a fractional amount of inert gas to continuously flow into the oven chamber cavity when the switch 184 is on.

The oven 10 is particularly well suited for the "burn-in" of integrated circuits (IC's). Electrical power cables for energizing the IC's are fed through the access port 80 which is then sealed with a suitable sealant to atmospherically seal the oven chamber cavity 39 from the outside environment. Integrated circuits are then placed into the oven chamber cavity 39 and connected to the electrical power cables. The oven is energized by off-on power switch 142 and the temperature of the oven is set by the temperature controller 144 which controls the heat emitted by the electrical resistance heater 100.

The recirculating fan 52 recirculates the heated inert atmosphere through and inside the oven cavity chamber 39 in the direction of the arrows as shown in FIG. 1. The atmosphere is drawn across the electrical resistance heater 58, through the flanged circular semi-spherical dish opening 56, down the supply duct 30, through the perforated oven right side wall 42, across the oven chamber work cavity 39, through the perforated left side wall 44, up across the surface area of the heat exchanger 62, and back to the electrical resistance heater 58. Simultaneously, the exhaust fan is pulling air through the air inlet duct portion 66 and the air outlet duct portion 68 where the volume of air flow is controllably regulated by the damper 70 which is servo controlled by the control motor 148 connected in a feedback loop to the temperature controller 144.

Inert gas to prevent oxidation of the integrated circuit leads during burn-in initially purges the oven cavity chamber 39 at a high rate through the solenoid valve 188 and once the desired oxygen level is reached, solenoid valve 188 is shut automatically by the oxygen controller 194 and solenoid valve 192 which is manually set permits a continuous flow of a fractional amount of inert gas to maintain the inert gas atmosphere with the oven cavity chamber 39 and the surrounding air flow supply ducts.

If an over temperature condition is reached and is sensed by the high limit temperature controller 150, the contactor 164 opens, light 168 illuminates, and the alarm 162 sounds. The alarm 162 is subsequently silenced by the switch 160 and light 158 is turned off by resetting the high limit temperature controller 150.

When a heating cycle requires a continuous change of fresh air volume to pass through the oven, air may be taken in through atmospheric inlet 78 and discharged through atmospheric outlet 79 by way of a suitable duct work and through the utilization of an exhaust fan which is not shown in the drawings. Depending upon the heating cycle, it may be advantageous to use atmospheric inlet 78 and atmospheric outlet 79 in lieu of the heat exchanger 62 and the inert atmosphere.

Various modifications can be made to the oven of the present invention without departing from the apparent scope thereof.

Having thus described the invention, what is claimed is:

1. An oven for the burn in of integrated circuits comprising:
   (a) An oven unit including:
      (i) A first vessel having walls defining a cavity therein, said walls having pneumatic openings therethrough to provide a pneumatic inlet and outlet to said cavity; and
      (ii) A second vessel disposed about said first vessel such that a closed pneumatic passageway is formed from said outlet to said inlet;
   (b) Heating means for heating fluids located in said pneumatic passageway;
   (c) Heat exchanger means operably connected to said oven unit for absorbing heat from fluids located in said pneumatic passageway; and
   (d) Control means responsive to the temperature in said oven unit and operably affixed to said heat exchanger means for controlling the rate of heat absorption by said heat exchanger means.

2. The oven of claim 1 further comprising means to maintain an inert atmosphere within said heating means comprises an electrical resistance heater.

3. The oven of claim 1 wherein said heating means comprises an electrical resistance heater.

4. The oven of claim 1 wherein said heat exchanger means comprises an air inlet duct portion, an air outlet duct portion, damper means positioned in said air outlet duct portion for controlling the flow of fluid through said air outlet duct portion, and an exhaust means connected to said air outlet duct portion for causing the exhaust of fluids through said air outlet duct portion.

5. The oven of claim 1 wherein said heat exchanger means comprises a member extending partialy through said heat exchanger means to divide said heat exchanger means into an air inlet duct portion and an air outlet duct portion, said air outlet duct portion including a damper means for controlling the flow of fluid through said air outlet duct portion.

6. The oven of claim 5 wherein said control means regulates said damper means through a feedback servo control loop.

7. The oven of claim 1 wherein said control means comprises a temperature controller to sense the temperature of the oven unit and to switch said heating means, a control motor connected between said temperature controller and a damper unit in a servo feedback loop to regulate the position of said damper unit in said heat exchanger means, and a high limit temperature recorder whereby said temperature controller is disabled in the event that an oven temperature condition is sensed by said high limit temperature recorder.

8. The oven of claim 7 wherein said control means further comprises an inert gas regulation means that selectively:
   (a) purges said oven unit with inert gas; and
   (b) allows a continuous fractional flow of inert gas to be valved into said oven unit to maintain a constant inert atmosphere.

9. The oven of claim 1 further comprising:
   (a) An inlet valve disposed through said second vessel such that said pneumatic passageway is pneumatically connectable to the exterior of said second vessel; (b) An outlet valve disposed through said second vessel such that said pneumatic passageway is pneumatically connectable to the exterior of said second vessel, said inlet and outlet valve being selectively openable and closeable during the operation of said heating means.

10. A system for controlling a heating oven comprising:
   a. a temperature controller means to sense the temperature in an oven chamber cavity and to electrically switch a heating means;
   b. a servo motor means to regulate the position of a damper in a heat exchanger integral to said oven and connected to said temperature controller means forming a feedback loop;
   c. a high limit temperature controller to sense an over temperature condition and disable said heating means;
   d. an inert gas means to maintain an inert gas atmosphere in said oven chamber cavity.

11. In an oven having a first vessel and a second vessel, the second vessel having pneumatic openings therethrough and being disposed within the first vessel, an improvement comprising a heat exchanger unit for absorbing & removing heat that is attachable to the first vessel, the heat exchanger unit being responsive to the temperature in the oven and being operative to control the temperature in the oven by selectively varying the rate at which the heat exchanger unit absorbs heat from the oven.

* * * * *